US005775947A

United States Patent [19]

Suzuki et al.

[11] Patent Number: 5,775,947

[45] Date of Patent: Jul. 7, 1998

[54] MULTI-CONTACT CONNECTOR WITH CROSS-TALK BLOCKING ELEMENTS BETWEEN SIGNAL CONTACTS

[75] Inventors: Takao Suzuki; Goro Haga; Kazushi Kamata, all of Tokyo, Japan

[73] Assignee: Japan Aviation Electronics Industry, Limited, Tokyo, Japan

[21] Appl. No.: 280,807

[22] Filed: Jul. 26, 1994

[30] Foreign Application Priority Data

Jul. 27, 1993 [JP] Japan ..... 5-040841 U

[51] Int. Cl.[6] ..... H01R 13/648

[52] U.S. Cl. ..... 439/608; 439/108

[58] Field of Search ..... 439/607, 608, 439/609, 610, 98, 92, 101, 108, 497, 507, 512, 513

[56] References Cited

U.S. PATENT DOCUMENTS 4,914,062 4/1990 Voltz ..... 439/608
4,975,084 12/1990 Fedder et al. ..... 439/608
5,174,770 12/1992 Sasaki et al. ..... 439/608
5,399,104 3/1995 Middlehurst et al. ..... 439/608
5,403,206 4/1995 McNamara et al. ..... 439/608

*Primary Examiner*—Hien Vu
*Attorney, Agent, or Firm*—Laff, Whitesel, Conte & Saret, Ltd.

[57] ABSTRACT

In each of a pluq and a receptacle of a multi-contact connector, a plurality of signal contacts and a plurality of ground contacts extend in parallel with one another and fixedly mounted in an insulator. The signal contacts are, in cross sectional view, arranged in rows and columns of a first matrix pattern, and the ground contacts are likewise arranged, in a second matrix pattern but with a displacement from each other by a half pitch in both of row and column direction. Each of the ground contacts is provided with blocking elements for blocking cross talk from occurrence between adjacent signal contacts. Each of the blocking elements is realized by a flange portion of each of the ground contacts which extends into a space between adjacent two of the signal contacts to shield them from each other.

8 Claims, 12 Drawing Sheets

MULTI-CONTACT CONNECTOR WITH CROSS-TALK BLOCKING ELEMENTS BETWEEN SIGNAL CONTACTS

BACKGROUND OF THE INVENTION

This invention relates to a multi-contact connector having a plurality of contacts for use in connection between signal transmission lines and/or power supplying lines and, in particular, to such an electrical connector adapted to connection between high rate transmission lines.

A conventional multi-contact connector comprises a multi-contact connector plug and a multi-contact connector receptacle. Each of the plug and the receptacle generally comprises an insulator, a set of first contacts mounted in the insulator, and another set of second contacts. The first contacts are mainly used for connection of signal transmission lines and therefore are usually called signal contacts. The second contacts are similar to the first contacts in shape but are mainly used for connection of ground lines and therefore are usually called ground contacts. Those contacts are pin type contacts in the plug but are socket type contacts in the receptacle which mate with the pin type contacts.

The first contacts or the signal contacts extend in parallel with each other in the insulator and, in the cross section, are arranged in rows and columns of a first matrix pattern with a constant pitch between adjacent rows and also between adjacent columns. The second contacts or the ground contacts extend in parallel with each other and also with the first contacts and are likewise arranged in rows and columns of a second matrix pattern with the constant pitch. The first and the second matrix patterns are displaced by a half of the pitch from each other in both of row and column. Accordingly, any one of the first or signal contacts is at the center of a square defined by four second or ground contacts adjacent each other in the second matrix pattern.

The conventional multi-contact connector having the above-mentioned structure has no serious problem as far as it is used for connection between low rate transmission lines and/or between power supply lines.

Recently, in an electronic apparatus, electronic parts are mounted on an internal printed circuit board at a high part mounting density. In addition, such apparatus often deals with signals of a high transmission rate. When the conventional multi-contact connector of the type described is used in such an electronic apparatus, there arise various problems which will be presently described.

Specifically, in the conventional multi-contact connector having such a structure that the ground contacts similar to signal contacts in shape are disposed in parallel with and between the signal contacts, cross talk is often caused to occur between adjacent ones of the signal contacts through which the signals of the high transmission rate flow. In order to suppress occurrence of the cross talk, stable grounding means are desired. To this end, one possible approach is to increase the number of the ground contacts. However, due to reduction of a space between the contacts resulting from the part mounting structure with a high density as described above, it is practically difficult to increase the number of the ground contacts. An increase in number of the ground contacts inevitably requires a restriction of the number of the signal contacts.

SUMMARY OF THE INVENTION

It is therefore an object of this invention to provide a multi-contact connector which are capable of suppressing occurrence of cross talk without reduction of the number of contacts in a unit area in a cross section in a perpendicular direction to the contacts.

According to this invention, a multi-contact connector plug is obtained. The plug comprises an insulator, a plurality of first contacts fixedly mounted in the insulator, and a plurality of second contacts fixedly mounted in the insulator. The first contacts extend in parallel with one another and are arranged, in cross-sectional view, in rows and columns of a first matrix pattern with constant row and column pitches. The second contacts extend in parallel with one another and with the first contacts and are arranged, in cross-sectional view, in rows and columns of a second matrix pattern with constant row and column pitches. The second matrix pattern is displaced from the first matrix pattern by a half pitch in the row and column directions. Each one of the second contacts is provided with blocking means interposing between two of the first contacts adjacent to the each one of second contacts for blocking cross talk from occurrence between the two of the first contacts.

In one aspect of this invention, each of the second contact has an L-shaped cross section to have two flange portions connected to each other, one of the two flange portions extending to interpose between two of the first contacts arranged in one row adjacent to the each one of second contacts, while the other of the two flange portions extending to interpose between two of the first contacts arranged in one column adjacent to the each one of second contacts, the two flange portions serving as the blocking means.

According to another aspect of this invention, the blocking means of each one of the second contact, extend along the first contacts and over the substantially entire length of the first contacts adjacent thereto.

According to this invention, a multi-contact connector receptacle is also obtained which comprises an insulator, a plurality of first contacts fixedly mounted in the insulator, and a plurality of second contacts fixedly mounted in the insulator. The first contacts extending in parallel with one another and are arranged, in cross-sectional view, in rows and columns of a first matrix pattern with constant row and column pitches. The second contacts extend in parallel with one another and with the first contacts and are arranged, in cross-sectional view, in rows and columns of a second matrix pattern with constant row and column pitches. The second matrix pattern is displaced from the first matrix pattern by a half pitch in the row and column directions. Each one of the second contacts is provided with blocking means interposing between two of the first contacts adjacent to the each one of second contacts for blocking cross talk from occurrence between the two of the first contacts.

According to one aspect of the receptacle, each of the first contacts has a first expanded portion expanded in a first expanded direction and is fixed to the insulator at the first expanded portion so that the first expanded direction is in the row direction, each of the second contacts has a second expanded portion expanded in a second expanded direction and is fixed to the insulator at the second expanded portion so that the second expanded direction is in the row direction, and the second expanded portion is larger than the first expanded portion, the enlarged portions of adjacent two of the first contacts arranged in one column are shielded by second enlarged portions, as the blocking means, of adjacent two of the second contacts in one row extending between the adjacent two first contacts.

According to another aspect of the plug, each of the first contacts has a first expanded portion expanded in a first expanded direction and is fixed to the insulator at the first expanded portion so that the first expanded direction is in the row direction, each of the second contacts has a second expanded portion and is fixed to the insulator at the second expanded portion, the expanded portion being formed to have an L-shaped cross section by two flange portions connected to each other, one of the two flange portions extending to interpose between the first expanded portions of two of the first contacts arranged in one row adjacent to the each one of second contacts, while the other of the two flange portions extending to interpose between first expanded potions of two of the first contacts arranged in one column adjacent to the each one of second contacts, the two flange portions serving as the blocking means.

BRIEF DESCRIPTION OF THE DRAWINGS

FIG. 6 is a sectional view taken along a line VIII—VIII in FIG. 7(*a*);

DESCRIPTION OF PREFERRED EMBODIMENTS

Figure 1:
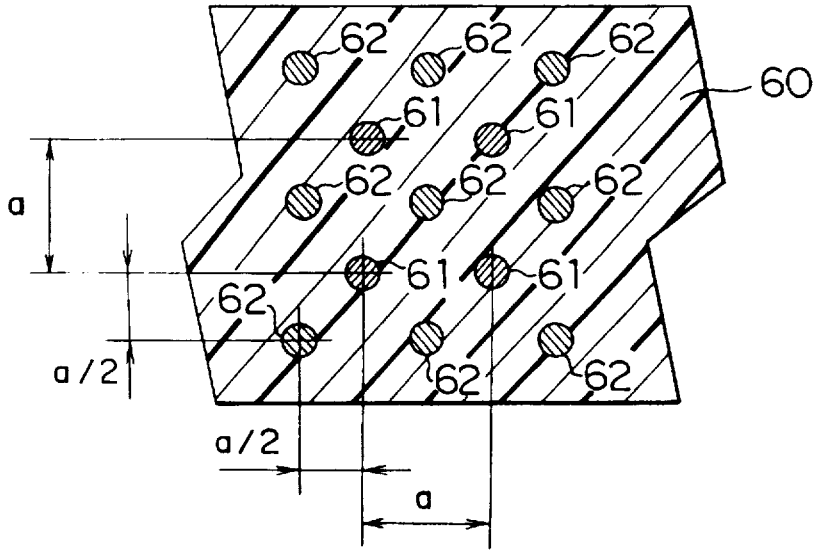
PRIOR ART FIG. 1
FIG. 1 is a partial cross sectional view of a conventional multi-contact connector and illustrates an arrangement of contacts in the cross section perpendicular to the contacts.

In order to facilitate an understanding of this invention, description will at first be made as regards a plug of a conventional multi-contact connector with reference to FIG. 1.

Referring to FIG. 1, the conventional plug comprises an insulator 60, a plurality of first contacts or signal contacts 61 fixedly mounted in the insulator 60, and a plurality of second contacts or the ground contacts 62 being also fixedly mounted in the insulator 60. Typically, the signal contacts 61 and the ground contacts 62 have a substantially similar shape, that is, a rod-like, or pin-like shape.

As shown in the figure illustrating the cross section taken along a line perpendicular to the contacts, the signal contacts 61 are arranged in rows and columns of a first matrix pattern. The rows extend in parallel with each other with a constant pitch a between adjacent ones, while, the columns extend In parallel with each other with a constant pitch a between adjacent ones but in perpendicular to the rows.

Likewise, the second contacts or the ground contacts 62 are arranged in rows and columns of a second matrix pattern having the row and column pitches a similar to the first matrix pattern.

However, the first matrix pattern and the second matrix pattern are out of position from each other or displaced from each other by a/2 in the row and column directions. Accordingly, any one of signal contacts 61 is disposed in a center of a square defined by four ground contacts 62 adjacent to each other.

A conventional receptacle for mating with the plug of FIG. 1 also comprises an insulator, a set of first socket contacts fixedly mounted in the insulator, and a set of second socket contacts fixedly mounted in the insulator. The insulator, and the first socket contacts, and the second socket contacts are corresponding to and mate with the insulator, the signal contacts and the ground contacts in the plug, respectively. Accordingly, the first socket contacts are, in cross sectional view, disposed in the first matrix form and the second socket contacts are also disposed in the second matrix form. Socket type contacts can be used for contacts in the plug. In the case, the contacts in the receptacle are pin type contacts.

Figure 2B:
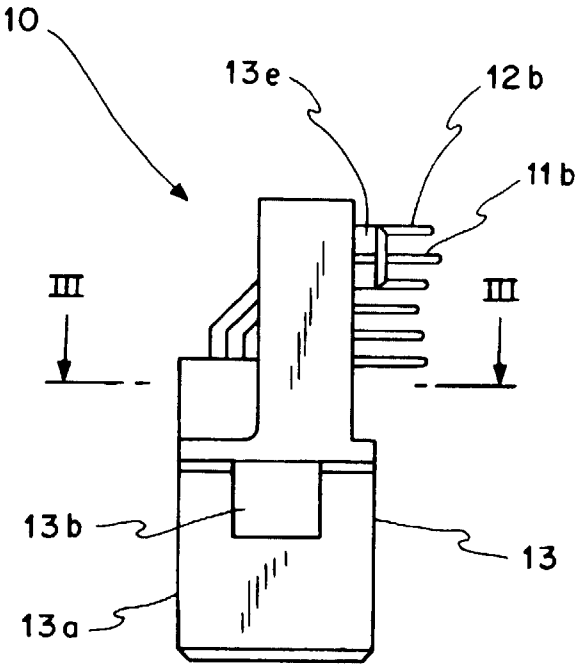
FIGS. 2(*a*) to 2(*c*) show a connector plug of a multi-connector according to a first embodiment of this invention, Fig.2(*a*) being a front view, FIG. 2(*b*), a side view, and FIG. 2(*c*) a bottom view.
Figure 2A:
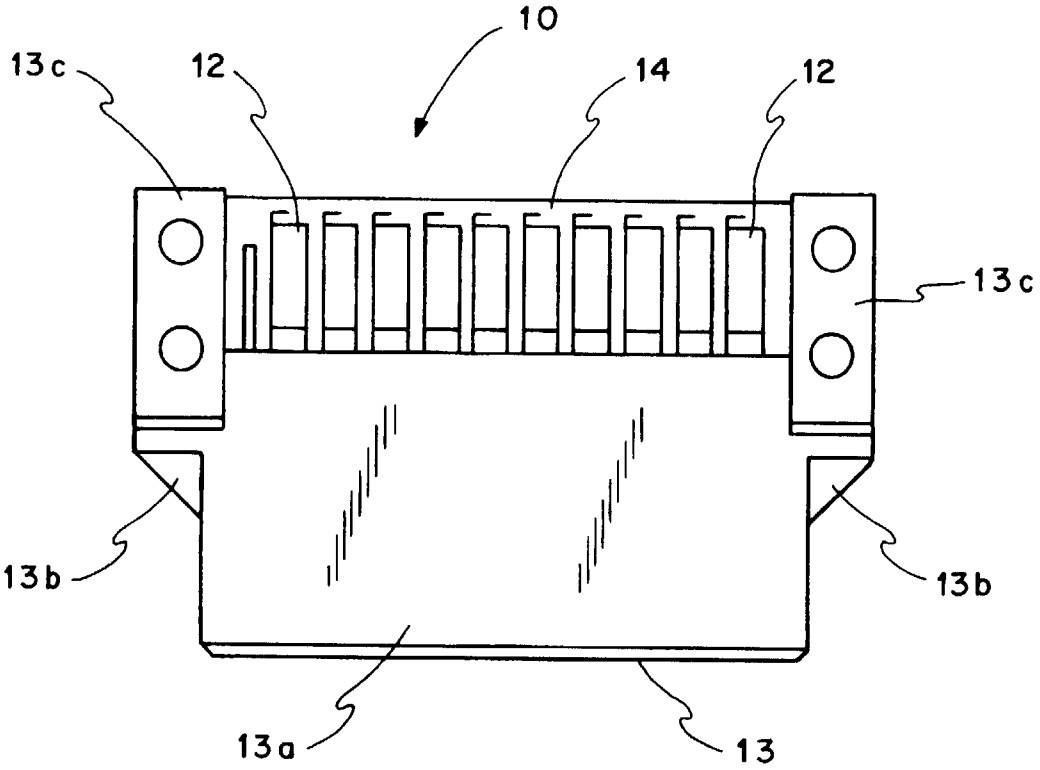
Figure 2C:
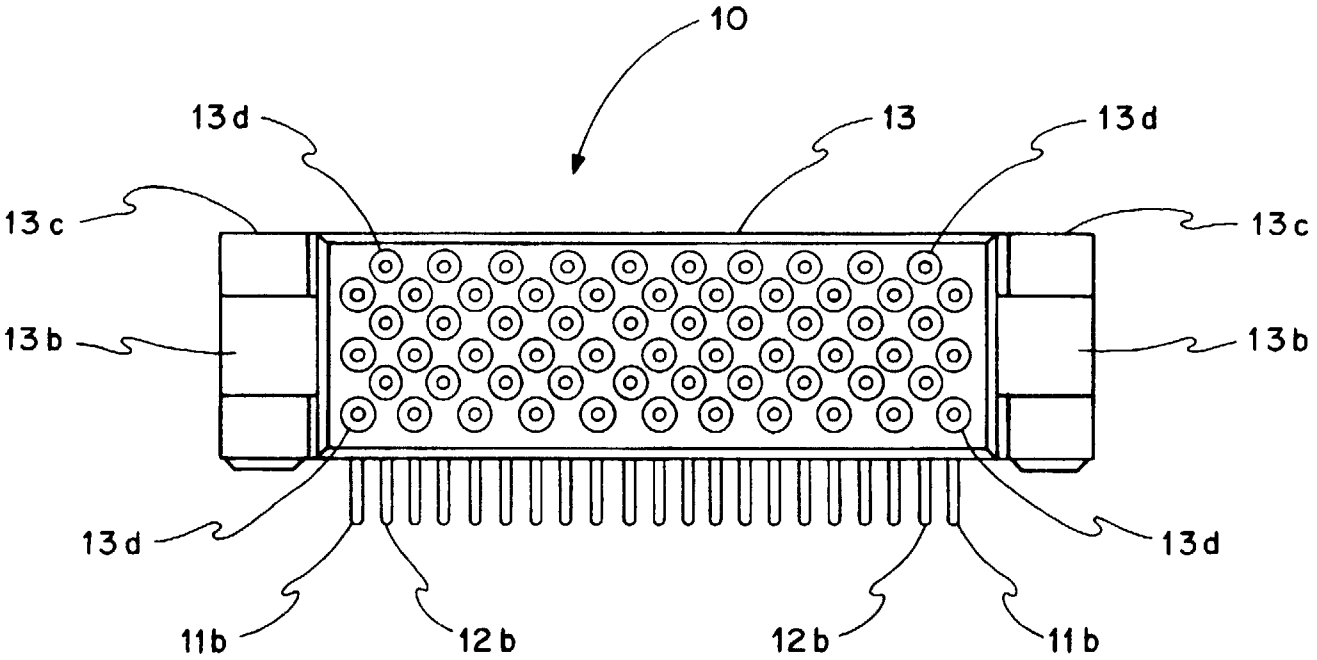
Figure 8:
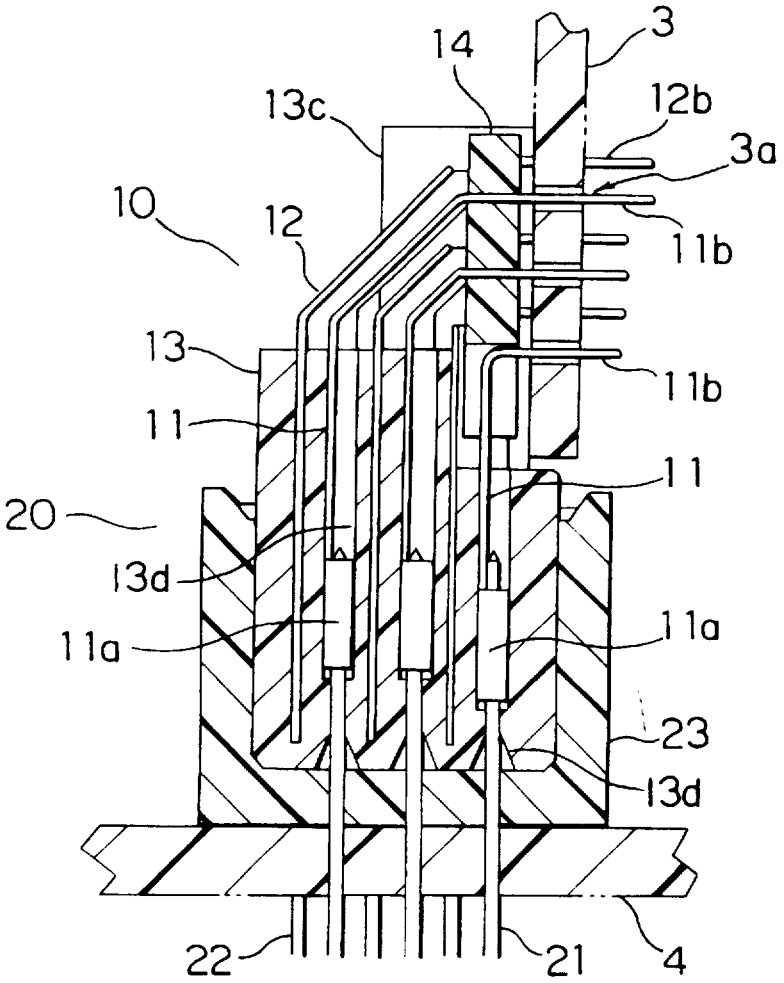
Figure 9B:
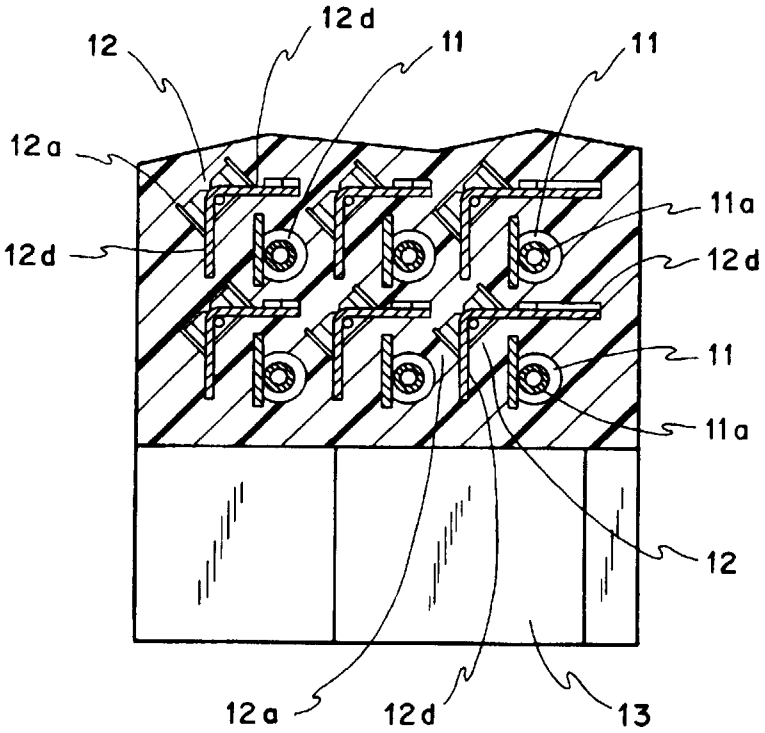
FIGS. 9(*a*) to 9(*d*) show a multi-contact connector having a plug mating with a receptacle according to another embodiment of this invention, FIG. 9(*a*) being a sectional view, FIG. 9(*b*), a partial enlarged sectional view taken along a line b—b in FIG. 9(*a*), FIG. 9(*c*), a partial enlarged sectional view taken along a line c—c in FIG. 9(*a*), and FIG. 9(*d*), a partial enlarged sectional view taken along a line d—d in FIG. 9(*a*)
Figure 9A:
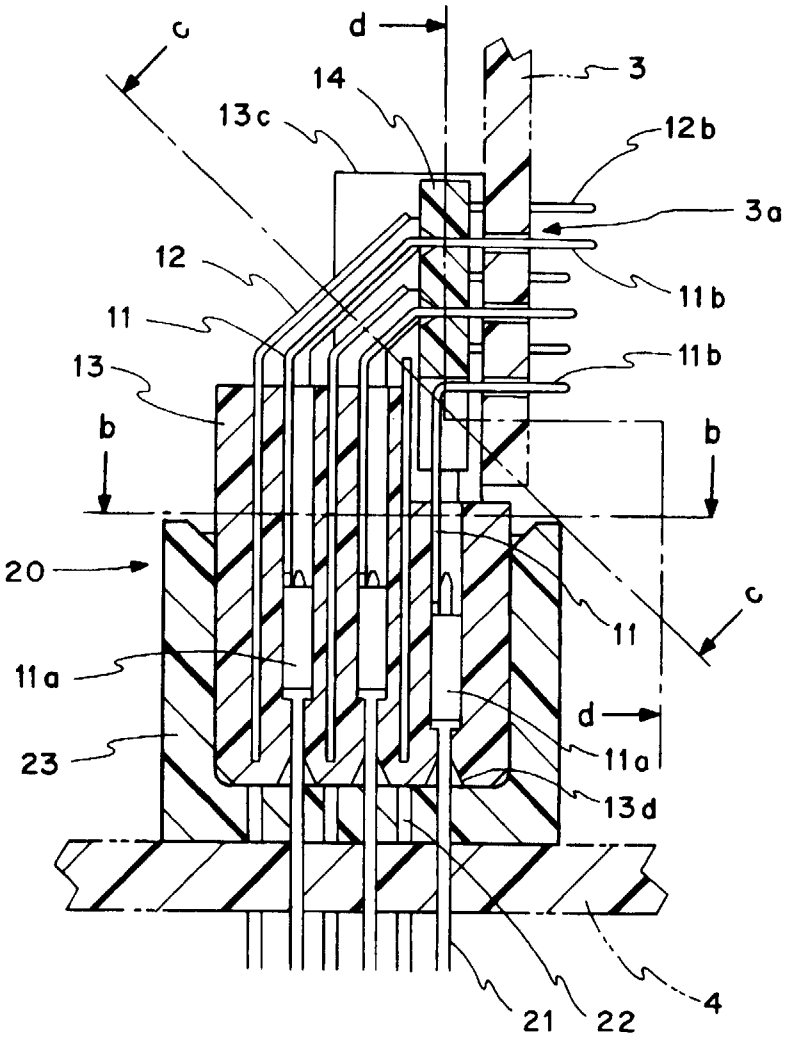
Figure 9D:
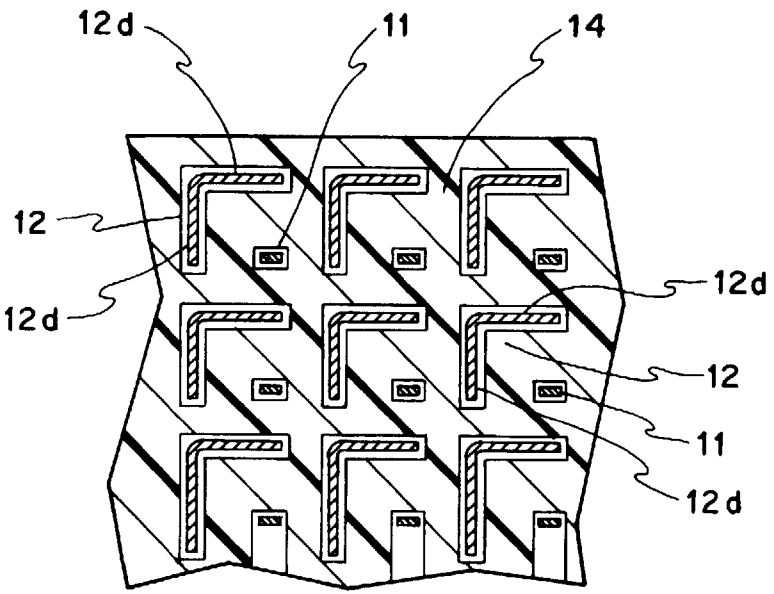
Figure 9C:
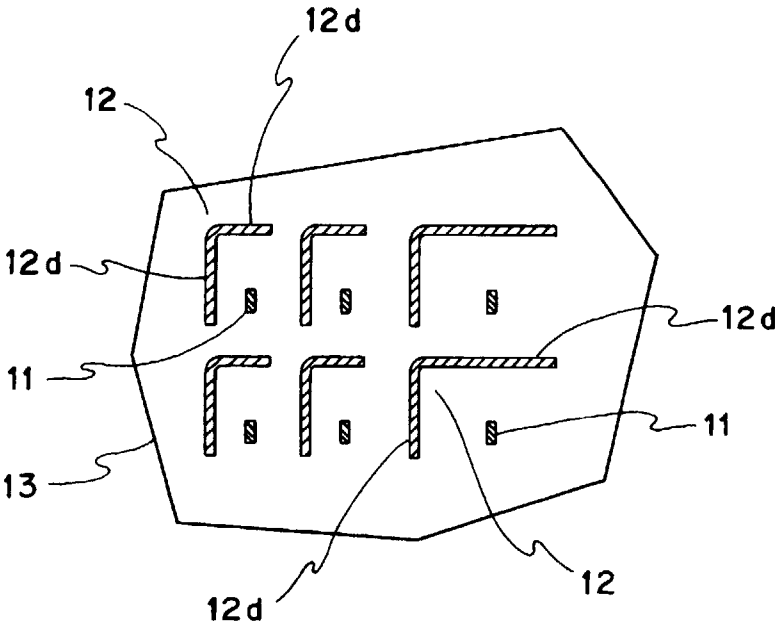

Now, description will proceed to a multi-contact connector according to a first embodiment of this invention with reference to FIG. 2(*a*) through FIG. 8.

Referring to FIGS. 2(*a*) to 2(*c*), a plug 10 comprises a plurality of signal contacts 11, a plurality of ground contacts 12, an insulator 13 embedded with the signal contacts 11 and ground contacts 13, and a locator 14.

Figure 3:
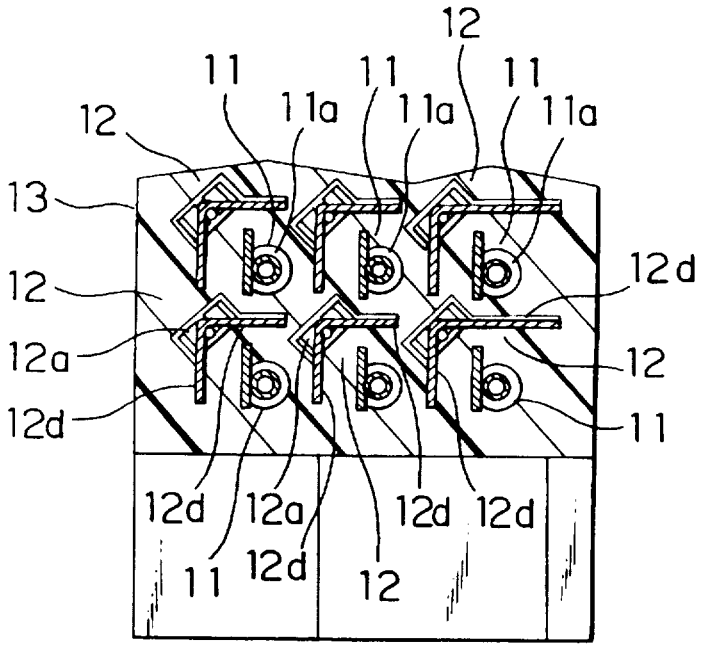
FIG. 3 is a partial enlarged sectional view taken along a line III—III in FIG. 2(*b*)

Referring to FIGS. 3 and 8, the signal contacts 11 extend in parallel with one another in the insulator 13 and are arranged, in the cross section, in rows and columns in a first matrix pattern. In the embodiment shown, each of the signal contacts 11 is a socket contact and has a cylindrical socket portion 11*a* integrally formed at an end of the contact. In FIG. 8, the socket portion 11*a* is shown at the lower end of the signal contact 11. Each signal contact 11 has a terminal portion 11*b* formed at the upper end thereof. The terminal portion 11*b* is bent to be substantially perpendicular to the axis of the socket portion 11*a*. The terminal, portion 11*b* penetrates through the locator 14 and is connected into a through hole 3*a* of a printed circuit board 3.

As will be understood from FIG. 3, each of the ground contacts 12 has an L-shaped cross section and is formed by bending a stripe of metal plate along a longitudinal straight line. That is, each ground contact 12 has two flange portions 12*d* connected to each other. The flange portions 12*d* serve as blocking elements for blocking cross-talk between adjacent signal contacts, as will later be described.

The ground contacts 12 extend in parallel with one another in the insulator 13 and are arranged, in the cross section, in rows and columns in a second matrix pattern which is displaced by a halt pitch in both of row and column from the first matrix pattern. As a result, one of two flange portions 12*d* of each ground contact 12 extends in a space between adjacent two signal contacts 11 arranged in one row adjacent the ground contact, while the other flange portion extends in a space between adjacent signal contacts arranged in one column adjacent the ground contact. Accordingly, each of signal contacts 11 is surrounded by flanges 12*d* of four ground contacts 12. Therefore, the cross talk between adjacent signal contacts 12 can be blocked by the flange portions 12*d* of the ground contacts 12.

In the embodiment shown, each of the ground contacts 12 is also socket type contacts. Therefore, like the signal contacts 11, each of ground contacts 12 has a socket portion 12*a* at an end, that is, the lower end thereof in FIG. 8, and has a terminal portion 12*b* at its upper end. The terminal portion 12*b* is bent to be substantially perpendicular to the axis of the socket portion 12*a*. The terminal portion 11*b* penetrates through the locator 14 and is connected into a through hole 3*a* of a printed circuit board 3.

Returning to FIGS. 2(*a*) to 2(*c*), the insulator 13 has a coupling portion 13*a* formed at its lower part as viewed in FIG. 2(*a*). The coupling portion 13*a* is to be coupled to or mate with a receptacle 20 of the multi-contact connector which will later be described in connection with FIG. 4(*a*) through FIG. 6. The coupling portion 13*a* has a pair of engaging protrusions 13*b* formed on opposite ends thereof which are to be engaged with the receptacle 20. A pair of attachment portions 13*c* are formed on opposite ends of an upper part of the insulator 13 to attach the insulator 13 to the printed circuit board 3, and has a space left therebetween along the insulator 13. In the space, the locator 14 is disposed.

The coupling portion 13*a* has a plurality of insertion holes 13*d* formed at is lower end for receiving insertion of contacts of the receptacle 20. The insertion holes 13*d* extend to the socket portions 11*a* and 12*a* of signal contacts 11 and ground contacts 12 for insuring connection of the socket contacts 11 and 12 with the contacts of the receptacle 20. The insulator 13 further has a pair of positioning projections 13*e* at its upper part for positioning the insulator 13 with respect to the printed circuit board 3.

Next, description will be made as regards the receptacle 20 of the multi-contact connector according to the first embodiment.

Figure 4B:
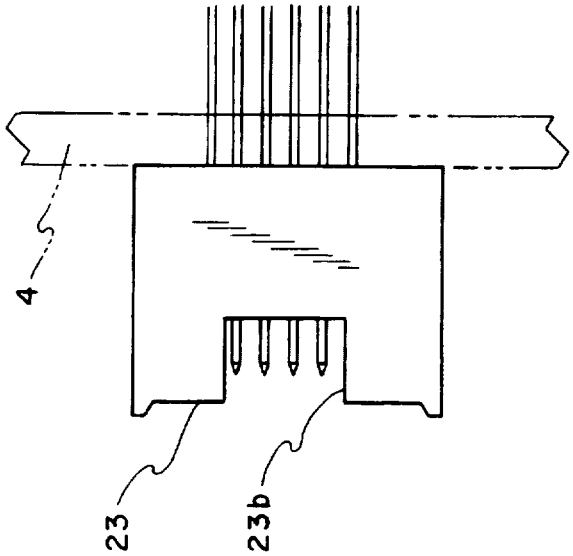
FIGS. 4 (*a*) and 4(*b*) show a receptacle of the multi-contact connector according to the first embodiment of this invention, FIG. 4(*a*) being a plan view and FIG. 4(*b*) being a side view.
Figure 4A:
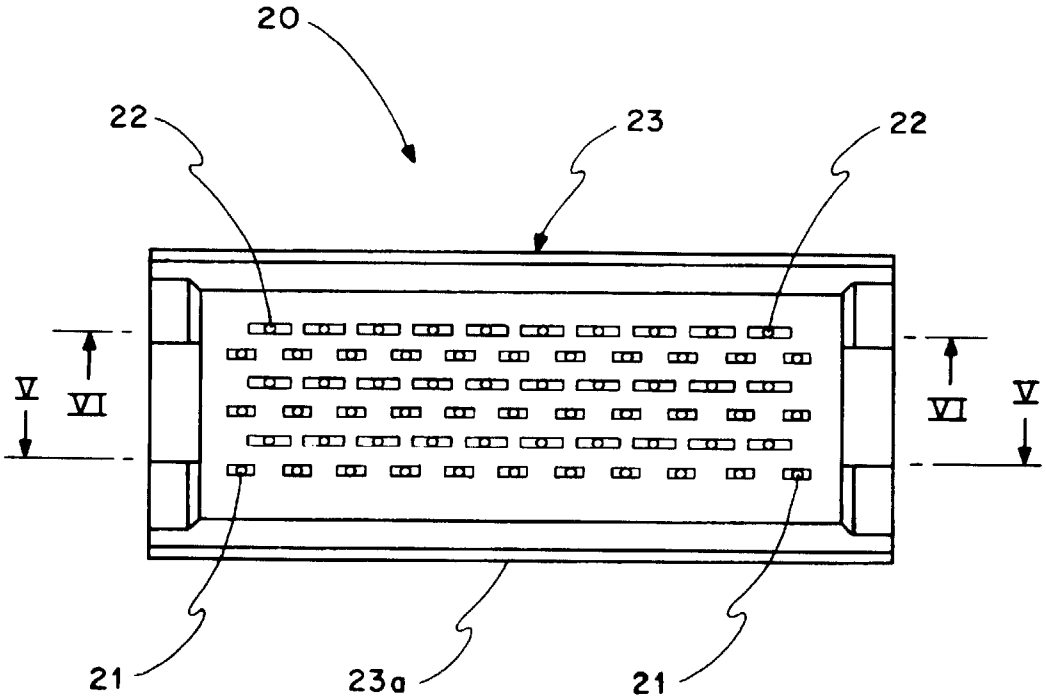
Figure 5:
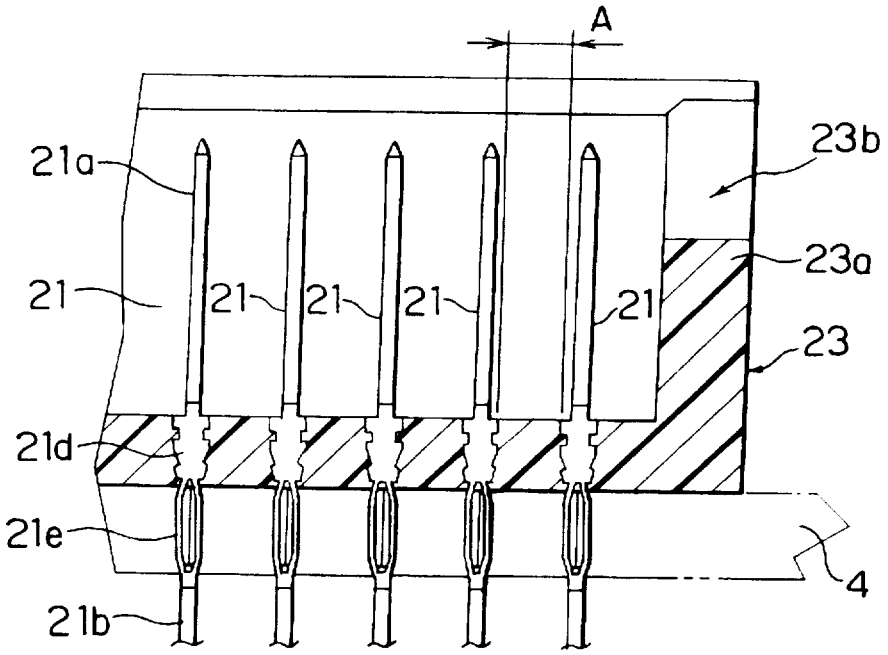
FIG. 5 is a partial enlarged sectional view taken along a line V—V in FIG. 4(*a*)
Figure 6:
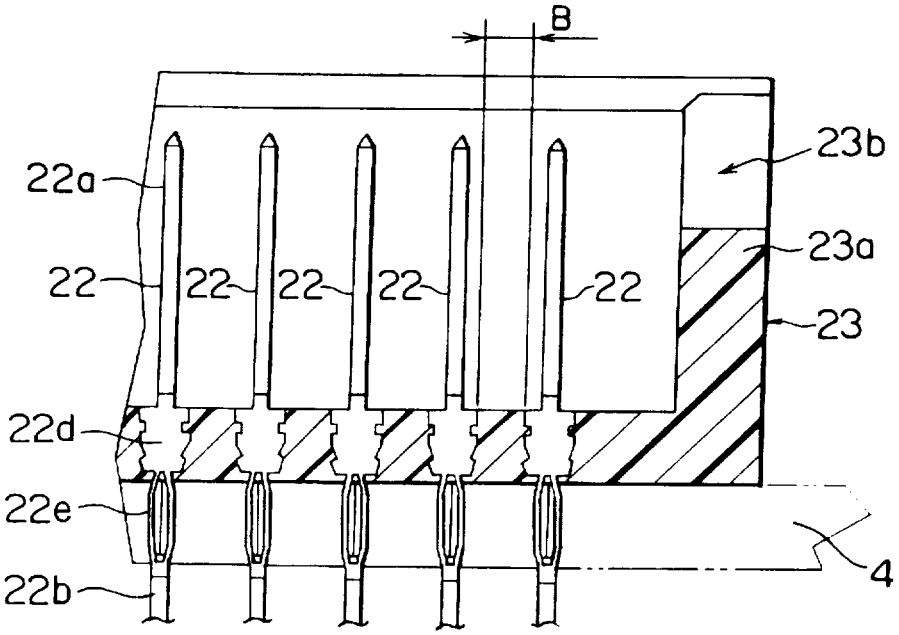
FIG. 6 is a partial enlarged sectional view taken along a line VI—VI in FIG. 4(*a*)

Referring to FIGS. 4 to 6, the receptacle shown therein comprises a plurality of signal contacts 21, a plurality of ground contacts 22, and an insulator 23 embedded with the signal contacts 21 and the ground contacts 22.

In this embodiment, each of the signal contacts 21 is a pin type contact. The signal contacts 21 are fixedly mounted in the insulator 23 and extend in parallel with one another with constant pitches so that signal contacts 21 are, in cross sectional views, arranged in rows and columns of the first matrix. Each of the signal contacts 21 has a contact potion 21*a* formed at an end portion, that is, at its upper end as viewed in FIG. 5 and projecting front the insulator 23. Each contact portion 21*a* is inserted into the hole 13*d* in the insulator 13 of the plug 10 and is connected to the socket portion 11*a* of the signal contact 11 of the plug 10. At the lower portion adjacent the contact portion, the signal contact 21 has an expanded portion 21*d* which is expanded at least one direction perpendicular to the contact. The at least one direction will be referred to as an expanded direction. The expanded portion 21*d* is press fitted or closely fitted into a corresponding one of small holes in the insulator 23 and is thereby fixed to the insulator 23. The signal contacts 21 are fixedly mounted in the insulator 23 so that the expanded direction is in a row direction of the matrix pattern. The signal contact 21 further has a press-fitting portion 21*e* just below the expanded portion 21*d*. The press-fitting portion 21*e* is inserted into a through hole 4*a* formed in the printed circuit board 4.

In this embodiment, each of the ground contacts 22 is also a pin type contact. The ground contacts 22 are also fixedly mounted in the insulator 23 and extend in parallel with one another with constant pitches so that ground contacts 22 are, in cross sectional view, arranged in rows and columns of the second matrix pattern. The first matrix pattern of the signal contacts 21 and the second matrix pattern of the ground contacts 22 are displaced from each other by a half pitch in rows and columns, as shown in FIG. 4(*a*). Like the signal contacts 21, each of the ground contacts 22 has a contact potion 22*a* at its upper end as viewed in FIG. 6, an expanded portion 22*d* which is expanded in at least one direction perpendicular to the contact, and a press-fitting portion 22*e* just below the expanded portion 22*d*. The contact portion 22*a* is inserted into the hole 13*d* in the insulator 13 of the plug 10 and is connected to the socket portion 12*a* of the ground contacts 12 of the plug 10. The expanded portion 22*d* is press fitted or closely fitted into a corresponding one of small holes in the insulator 23 and is thereby fixed to the insulator 23. The ground contacts 22 are fixedly mounted in the insulator 23 so that the expanded direction is in a row direction of the matrix pattern. The press-fitting portion 22*e* is inserted into a through hole 4*a* formed in the printed circuit board 4.

The insulator 23 has an outer wall portion 23*a* surrounding the contacts portions 21*a* and 22*a* to define a open hollow portion in which the coupling portion 13*a* of the plug 10 is inserted when the plug 10 and the receptacle 20 mate with or are coupled with each other. The outer wall portion 13*a* is formed with a pair of notches or cut-away portions 23*b* to be engaged with the engaging protrusion 13*b* of the plug 10.

In the receptacle 10, the signal contacts 21 and the ground contacts 22 are similar to each other in the shape and in mounting arrangement onto the insulator 23, but is only different from each other in the size of the expanded portions 21*d* and 22*d*. The expanded portion 22*d* of ground contact 22 is larger than that 21*d* of the signal contact 21 in the expanded direction.

In comparison with FIGS. 5 and 6, it will be noted that a space between contact portions 21*a* of the adjacent signal contacts 21 arranged in one row is equal to that between contact portions 22*a* of the adjacent ground contacts 22 arranged in one row. However, a space A between expanded portions 21*d* of the signal contacts 21 is larger than a space B between expanded portions 22*d* of the ground contacts 22. Accordingly, the expanded portions 22*d* of the ground contacts 22 interpose between expanded portions 21*d* of adjacent signal contacts 21 arranged in one column, as shown in FIG. 4(*a*). Therefore, the cross-talk between the adjacent signal contacts 21 can be reduced.

Figure 7B:
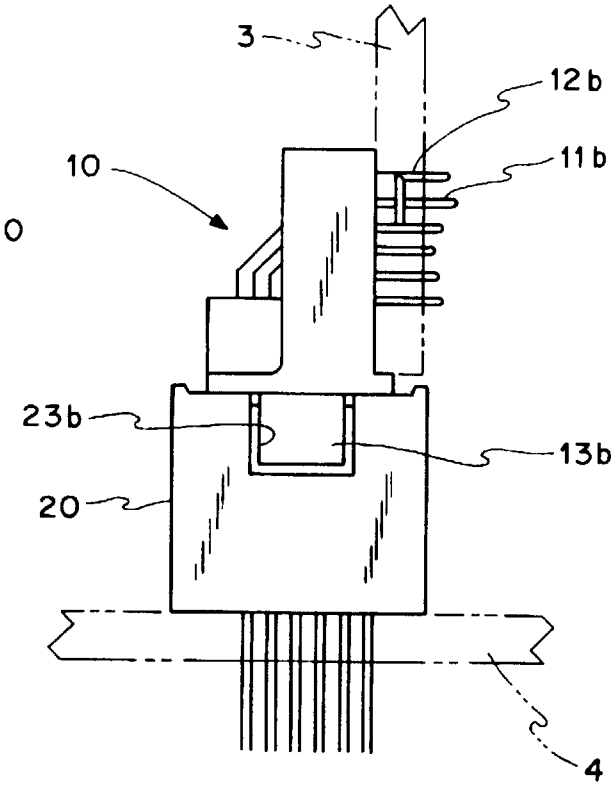
FIGS. 7 (*a*) and 7(*b*) show the multi-contact connector of the plug of FIGS. 2 and 3 mated with the receptacle of FIGS. 4–6, FIG. 7(*a*) and FIG. 7(*b*) being a front view and a side view, respectively.
Figure 7A:
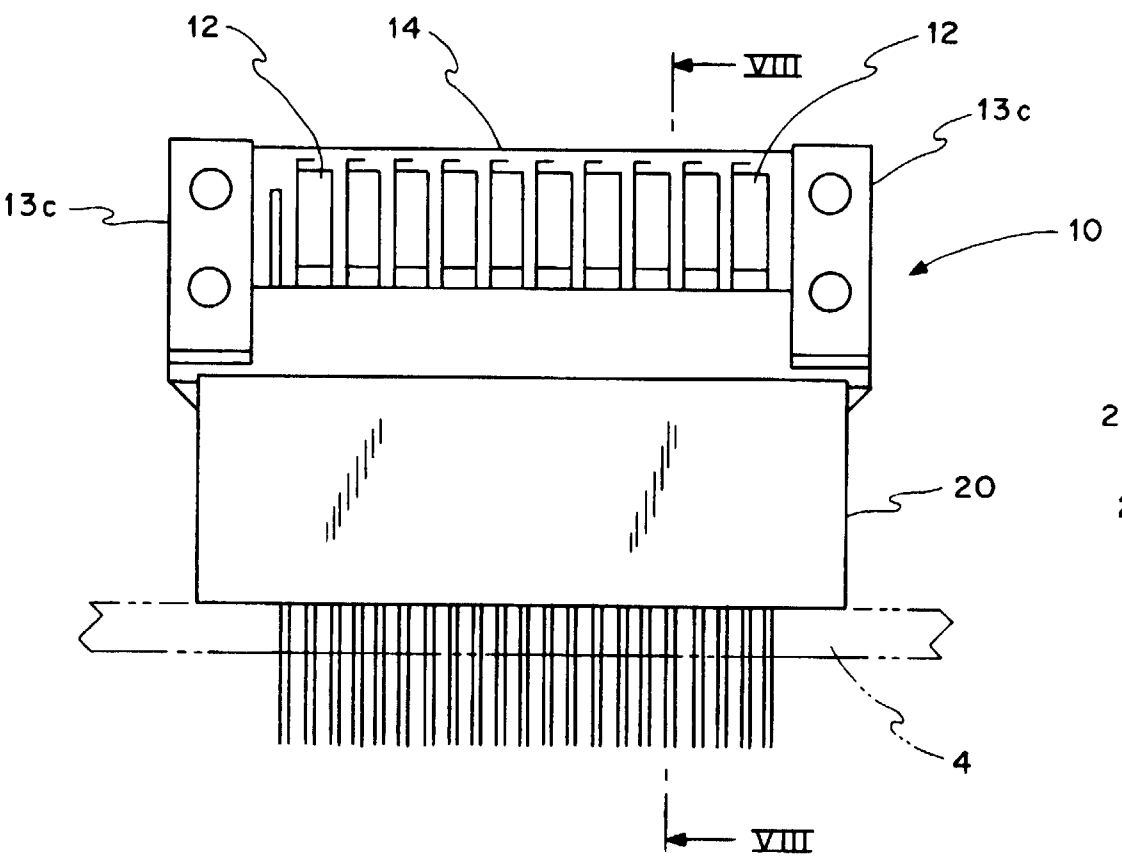

Referring to FIGS. 7 and 8, the plug 1*a* and receptacle 20 are coupled or mated with each other as shown therein. Upon coupling of the plug 10 and the receptacle 20, the printed circuit boards 3 and 4 are previously attached to the plug 10 and the receptacle 20, respectively. Then, the coupling portion 13*a* of the plug 10 is inserted into the hollow portion defined by the outer wall 23*a* of the receptacle 10. Thus, the signal contacts 11 and the ground contacts 12 of the plug 10 are connected to the signal contacts 21 and the ground contacts 22 of the receptacle which are inserted into the insertion holes 13*d* of the plug 10. Therefore, the printed circuit boards 3 and 4 are electrically connected by the multi-contact connector.

Now, description will be made as to another multi-contact connector according to a second embodiment, referring to FIGS. 9 to 11.

Referring to FIGS. 9(*a*) to 9(*d*), a plug 10 of the multi-contact connector according to this embodiment has a structure substantially similar to that of the plug shown in FIGS. 2(*a*) to 3. Similar parts are designated by the same reference symbols and description will be omitted. It is pointed out that the flange portions 12*d* of each ground contact 12 longitudinally extend along the adjacent signal contacts 11 from the socket portion 11*a* to the terminal portion 11*b*, as will be seen in FIGS. 9(*b*) to 9(*d*).

A receptacle 20 of the multi-contact connector according to this embodiment is also similar to the receptacle shown in FIGS. 4–8. Therefore, the similar parts are represented by the same reference symbols and description thereto is also omitted.

Figure 10:
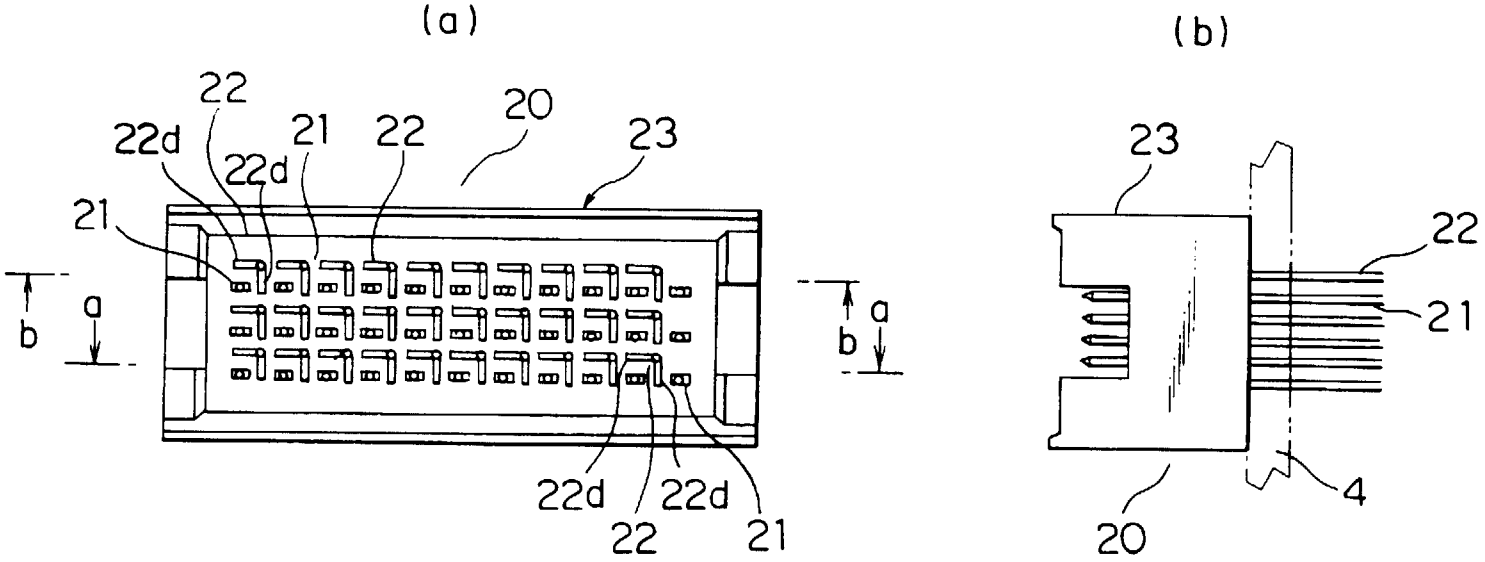
FIGS. 10(*a*) and 10(*b*) show the receptacle in FIGS. 9(*a*) and 9(*b*), FIG. 10(*a*) and FIG. 10(*b*) being a plan view and a side view, respectively.
Figure 11A:
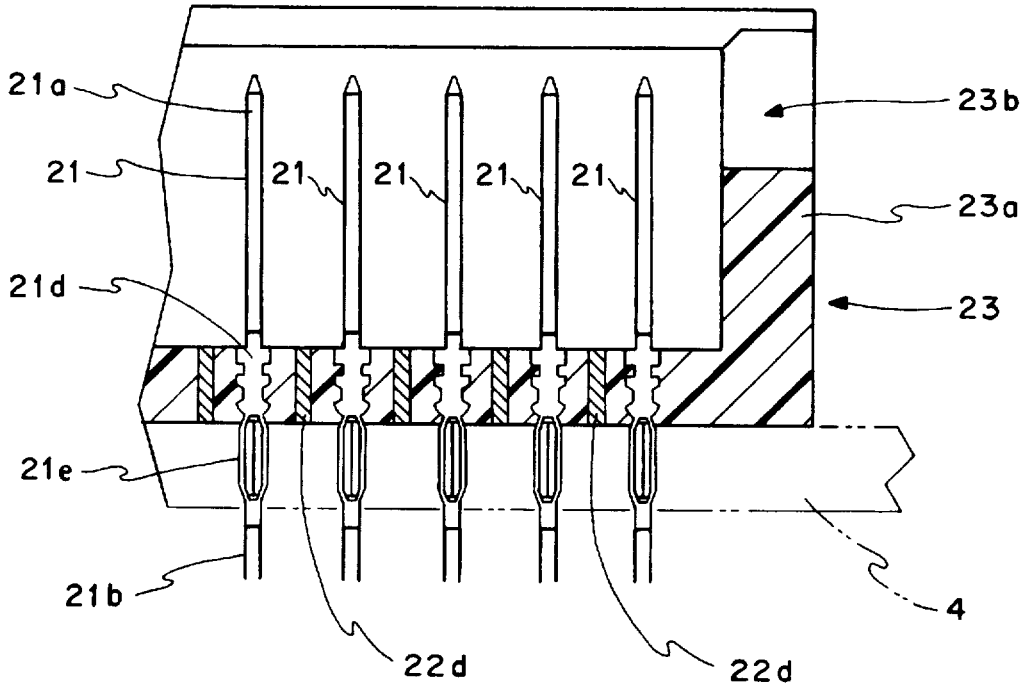
FIGS. 11(*a*) and 11(*b*) is different partial sectional views of the receptacle in the multi-connector in FIGS. 9(*a*) to 9(*d*), taken along a line a—a and another line b—b in FIG. 10 (*a*), respectively.
Figure 11B:
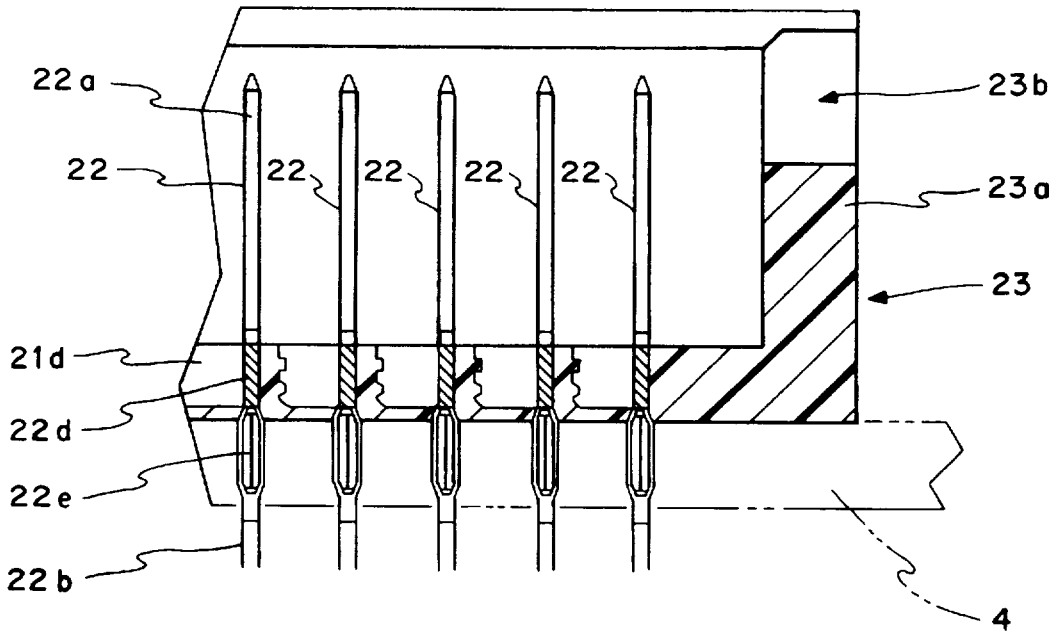

Referring to FIGS. 10(*a*) to 11(*b*), it is a different point that the ground contacts 22 of the receptacle 20 has the expanded portion 22*d* which is formed to have an L-shaped cross-section, that is, provided with two flange portions 22*f*. Accordingly, the expanded potion 12*d* of one signal contact 21 are surrounded by L-shaped flanges 22*f* of expanded portion 22*d* of four ground contacts 22 adjacent to the one signal contact 21, as shown in FIG. 10(*a*). The flange portions 22*f* serve as an element for blocking cross-talk from occurrence between adjacent signal contacts 21 in the similar manner as the flange portions 12*d* of the signal contacts in the plug 10 which is shown in and described in connection with FIGS. 2(*a*) to 3.

The ground contacts 12 and 22 of the plug 10 and receptacle 20 are mainly used for connection between ground lines. However, they can also be used for connection between low rate transmission lines. Further, since each of the ground contacts 12 and 22 has a large cross-sectional area and is therefore large in the capacity of the electrical current flow. Accordingly, the ground contacts can be used for contacts connecting between power supply lines.

What is claimed is:

1. A multi-contact cross talk blocking connector plug comprising an insulative housing defined by a bottom wall and side walls to be inserted into a recess in a housing of a receptacle connector so that said plug housing fits into said recess of said receptacle connector, a plurality of first contacts fixedly mounted in said insulative plug housing, said first contacts extending in parallel with one another and being arranged, in cross-sectional view, in rows and columns of a first matrix pattern with a constant pitch between rows and columns, and a plurality of discrete right angle second contacts fixedly mounted in said insulative plug housing, said second contacts being insulated from each other, said second contacts separately extending in parallel with one another and with said first contacts and being arranged, in cross-sectional view, in rows and columns of a second matrix pattern with a constant pitch between rows and columns, said second matrix pattern being displaced by a half pitch from said first matrix pattern in both the row and column directions, each one of said second contacts providing cross talk blocking means interposed between two of said first contacts for blocking cross talk from occurring between said two of said first contacts, the right angle of each of said second contacts having an L-shaped cross section with two flange portions connected to each other, one of said two flange portions of said L-shaped cross section being interposed between an adjacent two of said first contacts arranged in a row, the other of said two flange portions of said L-shaped cross section being interposed between an adjacent two of said first contacts arranged in a column, said two flange portions extending along said first contacts to provide said cross talk blocking means.

2. A multi-contact connector plug as claimed in claim 1, said two flange portions extending over substantially a socket portion of said first contacts adjacent thereto.

3. A multi-contact cross talk blocking connector receptacle comprising an insulative housing having a bottom wall and side walls defining a recess for receiving a housing of a plug connector so that said plug connector fits into said recess, a plurality of first contacts fixedly mounted in said insulative housing, said first contacts extending in parallel with one another and being arranged, in cross-sectional view, in a first matrix of rows and columns separated with a constant pitch between rows and columns, and a plurality of discrete second right angle contacts fixedly mounted in said insulative housing and insulated from each other, said second contacts being separate from each other and extending in parallel with one another and with said first contacts, second contacts being arranged, in cross-sectional view, in a second matrix of rows and columns and being separated with said constant pitch between rows and columns, said second matrix pattern being displaced from said first matrix pattern by a half pitch in both the row and column directions, each one of said second contacts having blocking means which are interposed between two of said first contacts adjacent to said each one of said second contacts for blocking cross talk from occurring between said two of said first contacts, each of said second contacts having two portions which are expanded so that a first expanded portion lays in the row direction and a second of said expanded portions lays in the column direction, and is fixed to said insulator so that said one expanded portion extends is in a direction of said rows, said other expanded portion extends in a direction of said column and along said first contacts to serve as said cross talk blocking means.

4. A multi-contact cross talk blocking connector receptacle as claimed in claim 3, wherein said given expanded portion is larger than said first expanded portion in said row direction, the enlarged expanded portions of two adjacent ones of said first contacts arranged in one column are shielded by the given enlarged expanded portions, as said cross talk blocking means, of two adjacent ones of said second contacts in one row extending between said adjacent two first contacts.

5. A multi-contact cross talk blocking connector receptacle as claimed in claim 3, wherein said expanded portions have an L-shaped cross section formed by said two flange portions connected to each other, one of said two flange portions extending to interpose between said first expanded portions of two of said first contacts arranged in one row adjacent to said each one of second contacts, the other of said two flange portions extending to interpose between first expanded portions of two of said first contacts arranged in one column adjacent to said each one of second contacts, said two flange portions serving as said cross talk blocking means.

6. A multi-contact cross talk blocking connector comprising a combination of a plug and a receptacle said plug comprising an insulative housing, said receptacle comprising a second insulative housing having a bottom wall and side walls defining a recess, said plug fitting into said recess and having a plurality of first contacts fixedly mounted in said insulative housing, said first contacts extending in parallel with one another and being arranged, in cross-sectional view, in rows and columns of a first matrix pattern with a constant pitch between rows and columns, and a plurality of discrete second right angle contacts fixedly mounted in said insulator, said second contacts being insulated from each other, said second contacts separately extending in parallel with one another and with said first contacts and being arranged, in cross-sectional view, in rows and columns of a second matrix pattern with a constant pitch between rows and columns, said second matrix pattern being displaced by a half pitch from said first matrix pattern in both the row and column directions, each one of said second contacts being provided with cross talk blocking means interposing between two of said first contacts for blocking cross talk from occurring between said two of said first contacts, each of said second contacts having an L-shaped cross section with two flange portions connected to each other, one of said two flange portions extending to and being interposed between an adjacent two of said first contacts arranged in a row, the other of said two flange portions extending to and interposed between an adjacent two of said first contacts arranged in a column, said two flange portions extending along said first contacts providing said cross talk block means;

a multi-contact cross talk blocking connector receptacle comprising said second insulative housing, a plurality of first contacts fixedly mounted in said insulative housing, said first contacts extending in parallel with one another and being arranged, in cross-sectional view, in a first matrix of rows and columns separated with a constant pitch between rows and columns, and a plurality of discrete second contacts fixedly mounted in said insulative housing and insulated from each other, said second contacts being separate from each other and extending in parallel with one another and with said first contacts, second contacts being arranged, in cross-sectional view, in a second matrix of rows and columns and being separated with said constant pitch between rows and columns, said second matrix pattern being displaced from said first matrix pattern by a half pitch in both the row and column directions, each one of said second contacts having blocking means which are interposed between two of said first contacts adjacent to said each one of said second contacts for blocking cross talk from occurring between said two of said first contacts, each of said second contacts having two portions which are expanded so that said first expanded portion lays in the row direction and a second of said expanded portions lays in the column direction and is fixed to said insulative housing so that said one expanded portion extends in a direction of said rows, said other expanded portion extends in a direction of said column and along said first contacts to serve as said cross talk blocking means.

7. A multi-contact cross talk blocking connector comprising a combination of a plug and receptacle, each of said plug and receptacle having an insulative housing and having a bottom wall and side walls, said walls of said receptacle defining a recess which receives said plug, said multi-contact connector plug having blocking means in the form of a plurality of second contacts, each one of said second contacts extending along corresponding ones of a plurality of first contacts and over and adjacent to substantially an entire length of said first contacts; said blocking connector plug comprising said insulative housing, a plurality of first contacts fixedly mounted in said insulative housing, said first contacts extending in parallel with one another and being arranged, in cross-sectional view, in rows and columns of a first matrix pattern with a constant pitch between rows and columns, and a plurality of discrete second right angle contacts fixedly mounted in said insulative housing, said second contacts being insulated from each other, said second contacts separately extending in parallel with one another and with said first contacts and being arranged, in cross-sectional view, in rows and columns of a second matrix pattern with a constant pitch between rows and columns, said second matrix pattern being displaced by a half pitch from said first matrix pattern in both the row and column directions, each one of said second contacts being provided with cross talk blocking means interposing between two of said first contacts for blocking cross talk from occurring between said two of said first contacts, each of said second contacts having an L-shaped cross section with two flange portions connected to each other, one of said two flange portions extending to and interposed between an adjacent two of said first contacts arranged in a row, the other of said two flange portions extending to and interposed between an adjacent two of said first contacts arranged in a column, said two flange portions extending along said first contacts providing said cross talk block means;

a multi-contact cross talk blocking connector receptacle comprising said insulative housing with said recess, a plurality of first contacts fixedly mounted in said insulative housing, said first contacts extending in parallel with one another and being arranged, in cross-sectional view, in a first matrix of rows and columns separated with a constant pitch between rows and columns, and a plurality of discrete second contacts fixedly mounted in said insulator and insulated from each other, said second contacts being separate from each other and extending in parallel with one another and with said first contacts, second contacts being arranged, in cross-section view, in a second matrix of rows and columns and being separated with said constant pitch between rows and columns, said second matrix pattern being displaced from said first matrix pattern by a half pitch in both the row and column directions, each one of said second contacts having blocking means which are interposed between two of said first contacts adjacent to said each one of said second contacts for blocking cross talk from occurring between said two of said first contacts, each of said second contacts having two portions which are expanded so that a first expanded portion lays in the row direction and a second of said expanded portions lays in the column direction, and is fixed to said insulator so that said one expanded portion extends in a direction of said rows, said other expanded portion extends in a direction of said column and along said first contacts to serve as said cross talk blocking means.

8. A multi-contact cross talk blocking connector as claimed in either claim 6 or 7, wherein each of said second contacts has a given expanded portion which is larger than the other of said expanded portions in said row direction, the enlarged expanded portions of two adjacent individual ones of said first contacts being said cross talk blocking means and being arranged in one column shielded by the given enlarged expanded portions of two adjacent ones of said second contacts in one row extending between said adjacent two first contacts.

* * * * *

UNITED STATES PATENT AND TRADEMARK OFFICE

CERTIFICATE OF CORRECTION

PATENT NO. : 5,775,947
DATED : July 7, 1998
INVENTOR(S) : Takao Suzuki; Goro Haga; Kazushi Kamata It is certified that error appears in the above-indentified patent and that said Letters Patent is hereby corrected as shown below:

Column 1, Line 54, delete "suppress occurrence" and --suppress an occurrence--
Column 1, Line 66, delete "are" and insert --is--
Column 1, Line 66, delete "suppressing" and insert --suppressing an--
Column 2, Line 31, delete "the period "." after contact
Column 3, Line 40, delete "FIG. 6" and insert --FIG. 8--
Column 4, Line 14, delete "a" and insert --a--
Column 5, Line 53, delete "views." and insert --view,--
Column 5, Line 54, delete "potion" and insert --portion--
Column 6, Line 16, delete "potion" and insert --portion--
Column 7, Line 25, delete "potion" and insert --portion--

Signed and Sealed this

Twelfth Day of January, 1999

*Attest:*

*Attesting Officer*

*Acting Commissioner of Patents and Trademarks*